US005628124A

United States Patent [19]

Skaugen et al.

[11] Patent Number: 5,628,124

[45] Date of Patent: May 13, 1997

[54] APPARATUS FOR DRYING A WEB

[75] Inventors: Borgeir Skaugen; Gregory L. Wedel, both of Beloit; Dale A. Brown, Milton, all of Wis.; David J. Archer, Durand, Ill.

[73] Assignee: Beloit Technologies, Inc., Wilmington, Del.

[21] Appl. No.: 418,145

[22] Filed: Apr. 5, 1995

Related U.S. Application Data

[63] Continuation of Ser. No. 64,840, May 19, 1993, Pat. No. 5,404,653, which is a continuation-in-part of Ser. No. 867, 722, Apr. 9, 1992, Pat. No. 5,249,372, which is a continuation of Ser. No. 167,672, Feb. 11, 1988, abandoned, which is a continuation-in-part of Ser. No. 14,569, Feb. 13, 1987, Pat. No. 4,934,067.

[51] Int. Cl.[6] ..... F26B 11/02

[52] U.S. Cl. ..... 34/117; 34/118

[58] Field of Search ..... 34/111, 114, 117, 34/118, 119

[56] References Cited

U.S. PATENT DOCUMENTS

| | | | |
|---|---|---|---|
| 2,537,129 | 1/1951 | Goodwillie | 92/49 |
| 2,714,342 | 8/1955 | Beachler | 92/53 |
| 2,959,222 | 11/1960 | Hornbostel | 62/360 |
| 3,079,699 | 3/1963 | Fry, Jr. | 34/13 |
| 3,110,612 | 11/1963 | Gottwald et al. | 117/64 |
| 3,263,344 | 8/1966 | Stickle | 34/116 |
| 3,314,162 | 4/1967 | Haywood | 34/111 |
| 3,384,973 | 5/1968 | Johansson | 34/111 |
| 3,395,073 | 7/1968 | Davis, Sr. | 162/369 |
| 3,868,780 | 3/1975 | Soininen et al. | 34/116 |
| 4,000,035 | 12/1976 | Schiel et al. | 162/290 |
| 4,011,124 | 3/1977 | Baxter | 34/118 X |
| 4,183,148 | 1/1980 | Koski et al. | 34/23 |
| 4,202,113 | 5/1980 | Kankaanpaa | 34/23 |
| 4,359,827 | 11/1982 | Thomas | 34/16 |
| 4,359,828 | 11/1982 | Thomas | 34/114 |
| 4,441,263 | 4/1984 | Vedenpaa | 34/115 |
| 4,481,723 | 11/1984 | Vedenpaa | 34/114 |
| 4,483,083 | 11/1984 | Chance | 34/113 |
| 4,510,698 | 4/1985 | Ely | 34/117 |

(List continued on next page.)

FOREIGN PATENT DOCUMENTS

| | | |
|---|---|---|
| 9001209 | 5/1990 | Germany . |
| 2173832 | 10/1986 | United Kingdom . |
| 8202937 | 9/1982 | WIPO . |
| 8300514 | 2/1983 | WIPO . |
| 8804206 | 6/1988 | WIPO . |

OTHER PUBLICATIONS

"Advances in Dryer Section Runnability" by G. Wedel & S. Palazzolo; TAPPI Journal; Sep. 1987; pp. 65–69.

"Examining Runnability in the Dryer Section" by I. Binns; Paper, Jul. 13, 1987; pp. 27–28.

"No. 16 Takes Shape"; Consolidated News; vol. 29, No. 4 Aug.–Oct. 1991; pp. 8–10.

"Neue Elemente Bei Der Papiertrocknung" by J. Fischer; Heimback–Seminar, Jun. 10, 1989, (Voith GmbH).

"Zehn Jahre Erfahrung mit Geschlossener . . . " by J. Linderot Wochenblatt Fur Papierfabrikation; Aug. 1986; NR 16; vol. 14; pp. 622–629.

"Analysis of Runnability Problems in the Paper Machine . . . " and Modern Concepts of Paper Drying; Manuscript; undated.

*Primary Examiner*—John M. Sollecito
*Assistant Examiner*—Steve Gravini
*Attorney, Agent, or Firm*—Dirk J. Veneman; Raymond W. Campbell; David J. Archer

[57] ABSTRACT

A single tier drying section is disclosed for drying a web. The drying section includes a dryer and a felt guided about the dryer such that the web is disposed between the dryer and the felt for drying a first side of the web. A further dryer is disposed downstream relative to the dryer and a further felt is guided about the further dryer such that the web is disposed between the further dryer and the further felt for drying a second side of the web. A dryer transfer mechanism is used for transferring the web from the dryer to the further dryer.

1 Claim, 9 Drawing Sheets

U.S. PATENT DOCUMENTS

| | | | |
|---|---|---|---|
| 4,539,762 | 9/1985 | Eskelinen et al. | 34/114 |
| 4,566,944 | 1/1986 | Mauranen et al. | 162/286 |
| 4,608,124 | 8/1986 | Mauranen et al. | 162/193 |
| 4,625,430 | 12/1986 | Aula et al. | 34/13 |
| 4,625,434 | 12/1986 | Karlsson et al. | 34/114 |
| 4,677,762 | 7/1987 | Futcher | 34/114 |
| 4,686,778 | 8/1987 | Kotitschke et al. | 34/117 |
| 4,934,067 | 6/1990 | Wedel | 34/117 |
| 4,986,009 | 1/1991 | Haessner et al. | 34/23 |
| 5,062,216 | 11/1991 | Hannigan | 34/16 |
| 5,144,758 | 9/1992 | Skaugen et al. | 34/117 |
| 5,146,696 | 9/1992 | Mayer et al. | 34/116 |
| 5,184,408 | 2/1993 | Kotitschke et al. | 34/117 |
| 5,205,052 | 4/1993 | Kraft et al. | 34/114 |
| 5,249,372 | 10/1993 | Wedel | 34/117 |
| 5,299,363 | 4/1994 | Kraft et al. | 34/117 |
| 5,321,899 | 6/1994 | Kade et al. | 34/114 |
| 5,404,653 | 4/1995 | Skaugen et al. | 34/117 |

APPARATUS FOR DRYING A WEB

CROSS REFERENCE TO RELATED APPLICATIONS

This is a continuation of application Ser. No. 08/064,840 filed on May 19, 1993 now U.S. Pat. No. 5,404,653, which is a continuation-in-part of U.S. Ser. No. 07/867,722 filed on Apr. 9, 1992, now U.S. Pat. No. 5,249,372, which was a File Wrapper Continuation of U.S. Ser. No. 07/167,672 filed Feb. 11, 1988, now abandoned, which was a continuation-in-part of U.S. Ser. No. 07/014,569 filed on Feb. 13, 1987, now U.S. Pat. No. 4,934,067.

All the disclosures of the aforementioned applications are incorporated herein by reference.

BACKGROUND OF THE INVENTION

1. Field of the Invention

This invention relates to an apparatus for dying a web of paper emerging from a press section of a papermaking machine. More particularly, this invention relates to an apparatus for drying a web in which the web is transferred without open draw between dryer sections thereby permitting threading of the web without the assistance of threading ropes and the drying of both sides of the web.

2. Information Disclosure Statement

With the ever increasing operational speed of papermaking machines a serious problem has existed in that there is a tendency for the paper web or sheet to flutter as the sheet progresses through the dryer section. Such sheet flutter is particularly evident when the sheet is transferred between succeeding sections of the dryer section as the web is transferred between these adjacent sections in an open draw. Such sheet flutter has been minimized by the use of single felting configurations in which the web and felt run jointly between respective top and bottom cylinders. However, the single felt configuration, although reducing the aforementioned problem of sheet flutter, introduces several disadvantages. Included amongst these disadvantages are, first, the heat transfer from the bottom cylinders is substantially reduced because the wet web is no longer in direct contact with the cylinders, the felt being interposed between the web and the drying surface of the respective cylinder. Second, the web has a tendency to separate from the felt as the web travels towards and around and then away from the bottom cylinder. Third, the initial threading of the web is not particularly easy.

A partial solution to the aforementioned single felt problems has been provided by the application of the so-called BELRUN dryer section. BEL RUN is a common law trademark of Beloit Corporation. With the BELRUN system, the bottom ineffective dryers are replaced by vacuum rolls which positively convey the web from one cylinder to the next. Recent installations of this type of dryer section have shown that the BELRUN concept can be extended to include a large number of dryers without any adverse effect on the web runnability. Such runnability results because the vacuum rolls are capable of conveying the web along the felt supported spans without the need for sheet tension or section draw points.

With the implementation of the single BELRUN section there exists a tendency to have a generation of stresses which develop in the web as the web dries. Such stresses impart a tendency for the dried paper to curl. Such adverse curling effect can be minimized or eliminated by drying the web from both sides, but two sided drying requires a transfer point in which the web is transferred from one felt to another felt. In the case of the BELRUN configuration, the web must be alternately dried on a top tier dryer section and then on a bottom tier dryer section. A top tier section may be defined as a group of dryers in which the bottom surface of the web contacts the dryers. A bottom tier section conversely and correspondingly may be defined as a group of dryers in which the top surface of the web contacts the dryers.

In order to efficiently transfer the web from one BELRUN section to another, a positive transfer arrangement is required. In the prior art such means for transferring the web from one drying section to the next has required the introduction of an open draw with the associated problems of sheet flutter and the like.

Modern paper drying machines are contemplated in which web speeds of 10,000 or more feet per minute are envisaged. Consequently, the introduction of such open draws would lead to serious problems of sheet flutter and numerous web breakages. The present invention seeks to overcome the aforementioned inadequacies of the prior art apparatus and to provide a drying apparatus which contributes a significant and non-obvious contribution to the paper drying art.

Another object of the present invention is the provision of an apparatus for dying a web of paper emerging from a press section of a papermaking machine such that the web is transferred between a first and second dryer section means without open draw, thereby permitting both threading of the web without the assistance of threading ropes and the drying of the web on both sides thereof.

Another object of the present invention is the provision of an apparatus for drying a web of paper in which open draws for the sheet or web is eliminated.

Another object of the present invention is the provision of an apparatus for drying a web of paper in which blow boxes wold be redundant.

Another object of the present invention is the provision of an apparatus for drying a web of paper in which ventilation of the pockets defined by the cylinders and the vacuum rolls is improved, thereby improving the drying rate of the web.

Another object of the present invention is the provision of an apparatus for drying a web of paper in which gear case leaks are inhibited and removal of broke is facilitated.

Another object of the present invention is the provision of an apparatus for drying a web of paper in which fewer steamfits are required and none of the dryers are redundant, thereby reducing the blow through rate.

Another object of the present invention is the provision of an apparatus for drying a web of paper in which the frame is symmetrical and in which the base frame is subjected to equal loading forces, thereby resulting in sturdy low-profile frame which reduces vibration and its attendant noise level.

Another object of the present invention is the provision of an apparatus for drying a web of paper in which the power required to drive the cylinders is reduced and due to the layout and configuration of the dryers, such arrangement lends itself to the provision of a low-profile hood.

Another object of the present invention is the provision of an apparatus for drying a web of paper in which runnability of the drying apparatus is increased and in which doctors can be applied to each dryer.

Another object of the present invention is the provision of an apparatus for drying a web of paper which permits automatic threading of a tail and subsequent web therethrough.

Another object of the present invention is the provision of an apparatus for drying a web in which open access to the dryers and vacuum rolls is provided and a supply of air can be fed uniformly through each of the vacuum rolls.

Another object of the present invention is the provision of an apparatus for drying a web of paper in which hoods are provided over and adjacent the vacuum rolls for handling the humid exhaust and possible eliminating the need for large scale exhaust hood construction.

Another object of the present invention is the provision of an apparatus for drying a web of paper in which such vacuum roll hoods can be provided for profiling the web by removing exhaust air from selected transfer sections of these hoods.

Another object of the present invention is the provision of an apparatus for drying a web ranging from tissue to fine paper.

Another object of the present invention is the provision of an apparatus for drying a web of paper in which the felt wrap is increased relative to the felt wrap of a two felt type drying section, particularly by decreasing the space between adjacent dryers.

Another object of the present invention is the provision of an apparatus for drying a web of paper in which the humidity is decreased by eliminating the closed pockets associated with a typical two felt type drying section.

Another object of the present invention is the provision of an apparatus for drying a web of paper in which the apparatus is no longer that a conventional dryer section but requires less equipment.

Another object of the present invention is the provision of an apparatus for drying a web of paper in which runnability is improved by eliminating open draws.

Another object of the present invention is the provision of an apparatus for drying a web of paper in which the felt supported draw is reduced to a minimum.

Another object of the present invention is the provision of an apparatus for drying a web of paper in which sheet control is provided by the direct application of vacuum.

Another object of the present invention is the provision of an apparatus for drying a web of paper in which there is no need for residual sheet tension to hold the sheet against the felt since the sheet is entirely supported by vacuum as it wraps the transfer roll. In a conventional Uno-Run dryer section, a draw is required in order to induce a tension in the sheet to hold the sheet as it wraps the bottom dryer. Although blow boxes can be used to prevent the sheet from leaving the felt, the vacuum produced by these boxes is quite low—in the order of 0.05 to 0.1 inches wc. Furthermore, the vacuum does not extend around the bottom dryer and it is generally not sufficient to hold the sheet against centrifugal forces and residual sheet tension is required to hold the sheet against the felt.

In the arrangement according to the present invention, the transfer roll vacuum is not so limited and typically, 4 inches wc is applied to the web which is more than four times the level needed for sheet support.

Another object of the present invention which is a less obvious factor relative to the runnability of the dryer section is the uniformity of dryer surface speeds. Such uniformity is obtained because the dryers are driven by the felt instead of by a gear train. Dryers which have slightly different diameters, perhaps due to manufacturing tolerances or differences in steam pressure, such differences result in unequal dryer surface speeds. These unequal surface speeds not only increase the drive load but also cause problems with sheet runnability.

Another object of the present invention is the provision of an apparatus for drying a web of paper in which threading of the apparatus is simplified.

More specifically, in a conventional Uno-Run system, the tail tends to separate from the felt on the bottom dryers and wander in the cross machine direction as it moves down the machine In the dryer section according to the present invention, the vacuum transfer rolls are equipped with internal dampers for concentrating the vacuum in front side threading chambers. When these dampers are closed, the vacuum in the threading chambers is increased from 4 inches wc to 10–12 inches wc. Such vacuum holds the tail tightly to the felt and prevents the tail from wandering and stabilizes the entire threading operation.

Additionally, when the apparatus according to the present invention is extended through the entire dryer section, the tail can be threaded without the use of ropes. Special air nozzles are located near the edges of each dryer to insure that the tail follows the felt and is transferred by the vacuum rolls. These air nozzles eliminate the need for threading ropes, threading equipment and maintenance. Furthermore, the aforementioned threading arrangement helps to insure safe operation of the apparatus.

Also, when the ropes are removed, a wider felt can be used which tends to further stabilize the edges of the sheet on the felt.

With the open symmetrical framing according to the present invention, broke removal, dryer access, and dryer visibility are greatly improved. Additionally, although not a requirement of the present invention, each of the dryers can be easily fitted with a doctor, such doctors being unloaded automatically with air cylinders if required.

The apparatus according to the present invention permits a significant reduction in the amount of paper machinery which is required to meet the design production. In addition to reducing the number of dryers, felt rolls and guides, there is also a corresponding reduction in the number of steamfits, the elimination of blow boxes and pocket ventilation ducts. Also, the present invention enables simplification of the dryer framing.

With the application of the "Silent Drive" dryer system (Silent Drive is a registered trademark of Beloit Corporation) and additionally with the low profile afforded by the framing layout of the present invention, dryer section noise and vibration will be reduced to a minimum. Furthermore, smaller drive motors can be installed due to the fact that the section inertia is reduced in view of the elimination of the bottom dryers utilized in a typical Uno-Run system. Additionally, the dryer hood can have a low profile construction, and hood door lifts can be installed on the back as well as the front of the machine.

Another object of the present invention is the provision of an apparatus for drying a web of paper in which the energy efficiency of the apparatus is improved.

More specifically, the dryer section of the present invention provides improved energy efficiency in the following three area. First, the drive load is reduced by having fewer dryers and less steamfit drag. Second, the amount of blow-through steam is reduced by minimizing the number of dryers. Third, the large blow-through quantities associated with the bottom dryers of conventional Uno-Run type sections are entirely eliminated.

Another object of the present invention is the provision of an apparatus for drying a web of paper in which the quality of the sheet is improved.

More specifically, the dryer section according to the present invention has the capability of affecting the sheet properties as follows. First, the tensile strength and stretch of the web in the machine direction is improved. Second, the tensile strength and stretch of the web in the cross machine direction is improved. Third, the tendency for the sheet to curl is reduced and fourth, the tendency to generate edge cockles is reduced.

Once the sheet leaves the press section, the machine direction tensile and stretch are affected primarily by the press section draw and somewhat less by the draw between dryer sections. In conventional drying sections, these dryer draws are usually set as low as possible but the minimum draw is dictated by runnability and sheet control. However, in the drying section according to the present invention, there is no minimum draw requirement for runnability. Nevertheless, the machine direction properties can still be affected in the usual way by pulling a draw between sections if such is deemed desirable.

In a somewhat similar manner, the cross machine direction tensile and stretch are affected by the cross machine direction sheet restraint. In an open draw, there is no restraint, so the sheet freely shrinks (although this shrinkage is greatest at the edges). In operation of a typical Uno-Run type drying section, there is a degree of web restraint as evidenced by the increase in trim and the decrease in edge cockles.

In the drying section according to the present invention, the sheet restraint is more positive than that provided by a typical Uno-Run system and this further reduces any tendency for edge cockles to develop. With the improved restraint provided by the present invention, a slight increase in cross machine direction tensile and a decrease in cross machine direction stretch is evident. The decrease in cross machine direction stretch is most pronounced at the edges where the sheet normally has the least restraint. Accordingly, the net effect according to the present invention, will be a sheet with more uniform properties in the cross machine direction.

The propensity to curl is caused by three factors as follows. First, fiber orientation, second fines and filler (bonding) distribution, and third, residual fiber stress.

The dryer section affects only the fiber stress. Curl is normally controlled by adjusting the drying from each side of the sheet by separate control of the top and bottom dryer steam pressures.

Accordingly, in the drying section according to the present invention, such control is provided by adjusting the steam pressures in subsequent sections.

Another particularly important object of the present invention is the provision of an apparatus for drying fine paper grades where directionality is important. More particularly, restrained drying of the web is an important feature of the present invention in that it will not permit the edges of the sheet to shrink more than the center portion of the sheet. The key to restraining the sheet while it is not held between the felt and the dryer drum is the vacuum in the transfer, or turning roll, below adjacent drums. The sheet may be restrained as stated hereinbefore by application of a vacuum within the range 1–10 inches wc and preferably approximately 4 inches wc.

Another object of the present invention is the provision of a single tier drying section having a single tier group of dryers followed by a further single tier group of dryers for drying the opposite side of the web, the drying section including the transfer means disposed between the group and the further group for controllably transferring the tail of the web and for subsequently controllably transferring a threaded web from the group to the further group such that the tail is transferred without the assistance of threading ropes.

Other objects and advantages of the present invention will be apparent to those skilled in the art by a consideration of the following detailed description taken in conjunction with the annexed drawings.

Although the detailed description and annexed drawings describe a preferred embodiment of the present invention, it should be appreciated by those skilled in the art that many variations and modifications of the present invention fall within the spirit and scope of the present invention as defined by the appended claims.

SUMMARY OF THE INVENTION

The present invention relates to a single tier drying section for drying a web. The drying section includes a dryer and a felt guided about the dryer such that the web is disposed between the dryer and the felt for drying a first side of the web. A further dryer is disposed downstream relative to the dryer and a further felt is guided about the further dryer such that the web is disposed between the further dryer and the further felt for drying a second side of the web. A transfer means transfers the web from the dryer to the further dryer.

More particularly, the dryer transfer means transfers the web without open draw from the dryer to the further dryer.

Additionally, the dryer transfer means includes a joint run of the felt and the further felt such that the web is disposed between the felt and the further felt such that the web is disposed between the felt and the further felt during passage through the joint run.

In one embodiment of the present invention, the transfer means further includes vacuum means disposed downstream relative to the joint run for positively maintaining the web in close conformity with the further felt when the felt and further felt diverge relative to each other downstream relative the joint run.

More specifically, the vacuum means is a vacuum roll.

Preferably, the single tier drying section extends from a press section to a calender section and includes a multiplicity of single tier subsections and the dryer transfer means includes a plurality of transfer mechanisms with each transfer mechanism being disposed between adjacent subsections such that as the web progresses through subsequent subsections, alternate sides of the web are dried.

The arrangement is such that alternate sides of the web are sequentially dried as the web progresses through the subsection and each of the subsections are disposed at different heights relative to each other with preferably every other subsection disposed at the same height relative to each other.

The dryer transfer meant also includes air nozzle means for assisting guidance of a tail of the web from the dryer to the further dryer.

In an alternate embodiment of the present invention, the dryer transfer means includes means for transferring the web with open draw from the dryer to the further dryer.

Additionally, the present invention relates to an apparatus and method for drying a web of paper emerging from the press section of a papermaking machine. The apparatus includes a first dryer section means for initiating the drying of the first side of the web. The first transfer means transfers the web from the press section to the first dryer section means. A second dryer section means is disposed downstream relative to the first dryer section means for initiating the drying of the second side of the web. The second side of the web is opposite to the first side of the web. A first dryer transfer means transfers the web without open draw between the first and the second dryer section means such that the first dryer transfer means permits both threading of the web without the assistance of threading ropes and the drying of both sides of the web.

More particularly, the first dryer section means also includes a first dryer section for initializing the drying of the first side of the web and a second section disposed downstream relative to the first dryer section for continuing the drying of the first side of the web. A second dryer transfer means transfers the web without opens draw between the first and the second dryer sections.

The first dryer section includes a first plurality of dryers and a first plurality of vacuum rolls with each of the vacuum rolls being disposed adjacent to a corresponding dryer of the first plurality of dryers such that the web extends alternately past each vacuum roll and a dryer in serpentine configuration. The first felt extends around the first plurality of dryers and the first plurality of vacuum rolls in close conformity with the web. The second dryer includes a second plurality of dryers and a second plurality of vacuum rolls with each vacuum roll of the second plurality of vacuum rolls being disposed adjacent to a corresponding dryer of the second plurality of dryers, such that the web extends alternately past each vacuum roll and dryer in serpentine configuration. A second felt extends around the second plurality of dryers and vacuum rolls respectively such that the second felt is disposed in close conformity with the web. The second felt and an unfelted portion of a downstream dryer of the first dryers defines a first pick-up section for transferring the web from the unfelted portion onto the second felt so that the web is transferred without draw from the first dryer section to the second dryer section.

Each of the vacuum rolls of the first and the second dryer sections are disposed in spaced in spaced close proximity to their adjacent corresponding dryers such that the felt draw between each of the vacuum rolls and the corresponding dryer is minimal, thereby inhibiting any tendency of the web to fluter relative to the supporting felts.

The apparatus also includes a base frame for rotatably supporting the first and second plurality of dryers such that the axis of the first and second plurality of dryers are disposed in the first plane. The frame also rotatably supports the first and the second plurality of vacuum rolls such that the axis of the first and second plurality of vacuum rolls disposed in a second plane with the first plane being disposed by the second plane.

An upstream vacuum roll of the second plurality of vacuum rolls is disposed in close proximity to the unfelted portion of the downstream dryer of the first dryer section. A first felt roll is rotatably supported by the base frame for guiding the second felt past and in conformity with the unfelted portion of the downstream dryer and thereafter around the upstream vacuum roll of the second dryer section such that the web is transferred from the unfelted portion to the second felt without open draw.

The first transfer means for transferring the web from the press section to the first dryer section means also includes a lead in roll which is disposed in spaced close proximity relative to the press section. The first felt extends around the lead in roll for transferring the web form the press section to the first dryer section means. A guide roll is disposed between the lead in roll and the first dryer section means for assisting the transfer of the web form the press section towards the first dryer section means. A transfer felt extends around the guide roll such that the transfer felt and the first felt defined therebetween a transfer section for transferring the web from the press section towards the first dryer section means.

The first transfer means also includes an upstream vacuum roll of the first dryer section means. This upstream vacuum roll cooperates with the first felt and the transfer felt such that the transfer section extends from the guide roll to the upstream vacuum roll so that the web emerging from the transfer section is guided around the upstream vacuum roll into the first dryer section means.

The second dryer section means also includes a third plurality of dryers with each of the dryers of this third plurality of dryers with each of the dryers of this third plurality of dryers being disposed downstream relative to the first dryer section means, A third plurality of vacuum rolls are each disposed in spaced close proximity relative to a corresponding dryer of the third plurality of dryers such that the web extends alternately past each vacuum roll and dryer of the second dryer section means in serpentine configuration.

The third plurality of dryers and vacuum rolls are rotatably secured to the base frame such that the third plurality secured to the base frame such that the third plurality of dryers are disposed in a third plane and the third plurality of vacuum rolls disposed in a fourth plane with the fourth plane being disposed above the third plane. A third felt extends past the third plurality of dryers and vacuum rolls such that the third felt supports the web through the second dryer section means with the second side of the web being urged by the third felt into close conformity with each dryer of the third plurality of dryers.

The first dryer transfer means also includes a downstream vacuum roll of the first dryer section means. A downstream vacuum roll and the downstream felt roll with the second felt supporting the web such that the web is conveyed and disposed between the second felt and the second dryer section means.

The first dryer transfer means also includes an upstream vacuum roll of the second dryer section means and an upstream felt roll. A third felt extends between the upstream felt roll and the upstream vacuum roll of the second dryer section means such that the third felt and the second felt define therebetween a first dryer transfer means section for transferring the web without open draw from the second to the third felt.

Subsequent dryer section means are provided such that the first, second, third and fourth dryer transfer means permit the transfer of the web between their respective dryer sections without open draw with an alternate reversing of the web such that the first and second side of the web are alternately dried as the web extends through the apparatus and past succeeding dryer section means.

The invention also includes a method of drying a web of paper emerging from a press section of a papermaking machine, the method comprising the steps of transferring the web from the press section a first dryer section of the apparatus, initiating the drying of a first side of the web during passage of the web through the first dryer and transferring the web Without open draw between the first dryer section and a downstream second dryer section, the web transfer being such that the web is reversed so that drying of a second side of the web is initiated during passage of the web through the second dryer section, the second side of the web being opposite to the first side of the web.

The method also includes the step of transferring the web without open draw between subsequent dryer sections such that the first and second side of the web are alternately exposed to the drying effect of the subsequent dryer sections in sequence.

In another embodiment of the present invention, a single tier drying section is disclosed for drying a web. The drying section includes a single tier group of dryers for drying a first side of the web. A felt extends around each of the dryers of said group such that the web is disposed between the felt and each of the dryers. A further single tier group of dryers is disposed downstream relative to the single tier group for drying a second side of the web. A transfer means is disposed between the group and the further group for controllably transferring a tail of the web and for subsequently controllably transferring a threaded web from the group to the further group such that the tail is transferred without the assistance of threading ropes.

In a more specific embodiment, a single tier drying section the transfer means includes a vacuum roll disposed immediately downstream relative to the group of dryers such that the felt extends from the group to and around the vacuum roll for guiding the tail and subsequently the threaded web from the group of dryers to the vacuum roll.

A further vacuum roll is disposed downstream relative to the vacuum roll. The further vacuum roll is disposed between the vacuum roll and the further group of dryers. The further vacuum roll is disposed in close proximity to the vacuum roll such that when the further vacuum roll is connected to a source of partial vacuum, the tail is urged and drawn from the vacuum roll toward the further vacuum roll.

A further felt extends from the further vacuum roll to the further group of dryers for guiding the tail controllably drawn from the vacuum roll such that the tail and subsequently the threaded web is guided from the further vacuum roll to the further group of dryers. The arrangement is such that the tail is automatically guided and threaded from the group to the further group without the assistance of threading ropes.

Additionally, the transfer means further includes air nozzle means disposed in the vicinity of the vacuum rolls for assisting the transfer of the tail from the group to the further group.

Also, the air nozzle means includes a first air nozzle disposed between the group and the vacuum roll for directing a first flow of air toward the tail in a direction generally opposite to a direction of travel of the tail for urging the tail to follow the felt rather than a heated surface of a last dryer of the group.

A second air nozzle is disposed between the vacuum rolls and between the further group for directing a further flow of air toward the vacuum roll and in a further direction generally opposite of the direction of travel of the tail for assisting detachment of the tail from the vacuum roll so that the tail is drawn toward the further felt extending around the further vacuum roll.

Although the following detailed description exemplifies a particular embodiment of the present invention, it should be understood by those skilled in the art that the present invention is not limited to such an arrangement. Rather the present invention as defined by the appending claims envisages a multitude of variations thereof, including a single felt extending around the dryers of the first and second dryer sections rather than using a first and second felt as shown in the drawings. Furthermore, although the present invention shows the drying apparatus with a first, second, third, fourth and fifth section means, the present invention is not limited to such an arrangement and the various dryer section means may be staggered and disposed in any configuration thereof in order to reduce the overall length of the drying section without the introduction of an open draw.

Also, the present invention envisages means for resiliently mounting the further vacuum roll such that in the event of a wad of paper extending between the vacuum roll and further vacuum roll such rolls would not be damaged.

DETAILED DESCRIPTION OF THE PREFERRED EMBODIMENT

Figure 1:
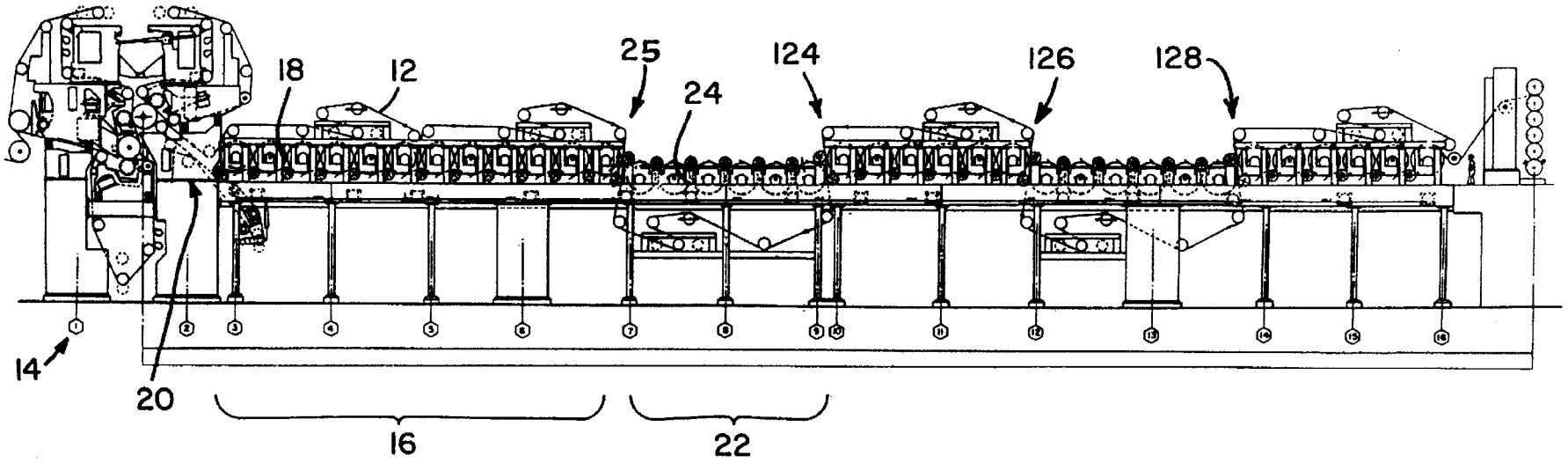
FIG. 1 is a side elevational view of the apparatus according to the present invention showing the press section the first transfer means, the first dryer section means, the second dryer section means, and the first dryer transfer means, according to the present invention.

FIG. 1 is a side elevational view showing the apparatus generally designated 10 for drying a web 12 of paper emerging from a press section, generally designated 14 of a paper making machine. The apparatus 10 includes a first dryer section means, generally designated 16 for initiating the drying of a first side 18 of the web 12.

A first transfer means generally designated 20 transfers the web 12 from the press section 14 to the first dryer section means 16.

A second dryer section means generally designated 22 is disposed downstream relative to the first dryer section means 16. This second dryer section means 22 initiates the drying of a second side 24 of the web 12. The second side 24 of the web 12 being opposite to the first side 18 thereof.

A first dryer transfer means generally designated 25 transfers the web 12 without open draw between the first and second dryer section means 16 and 22 respectively. The first dryer transfer means 25 permits both threading of the web 12 without the assistance of threading ropes and the drying of both sides 18 and 24 of the web 12.

Figure 2:
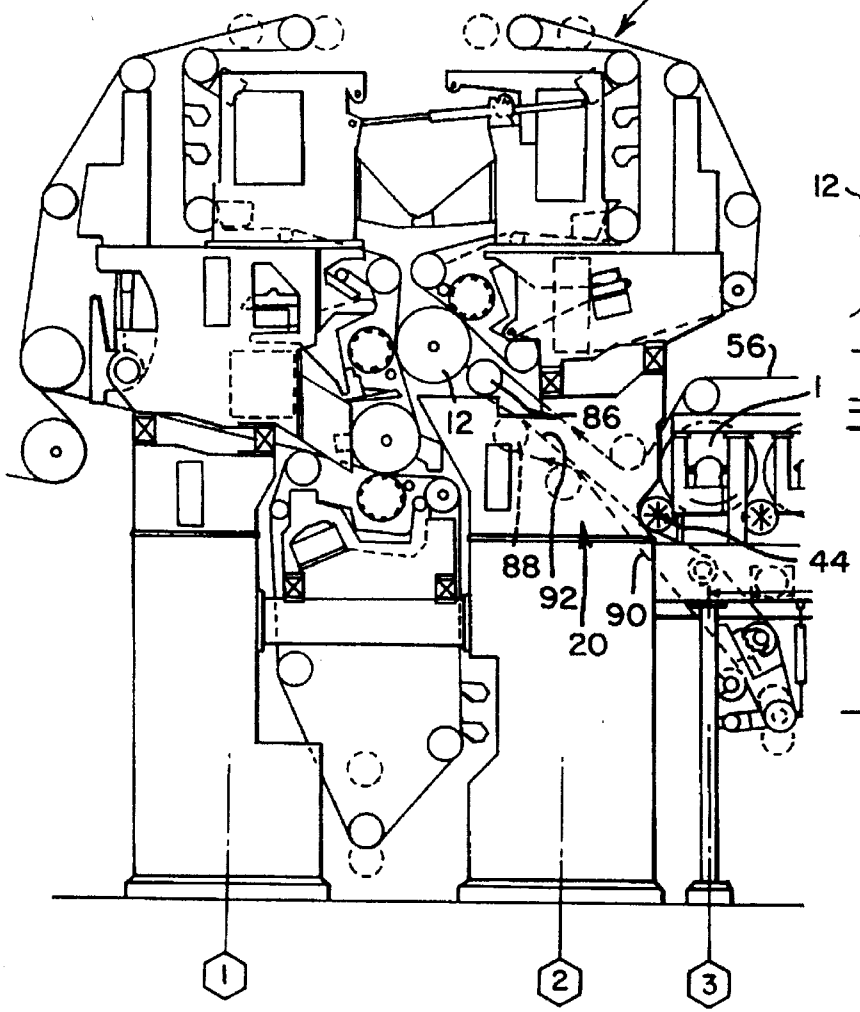
FIG. 2 is an enlarged fragmentary view of FIG. 1 showing the press section, and more particularly, the first transfer means for transferring the web from the press section to the first dryer section.

FIG. 2 shows in more detail the first transfer means 20 and will be described in more detail hereinafter.

Figure 3:
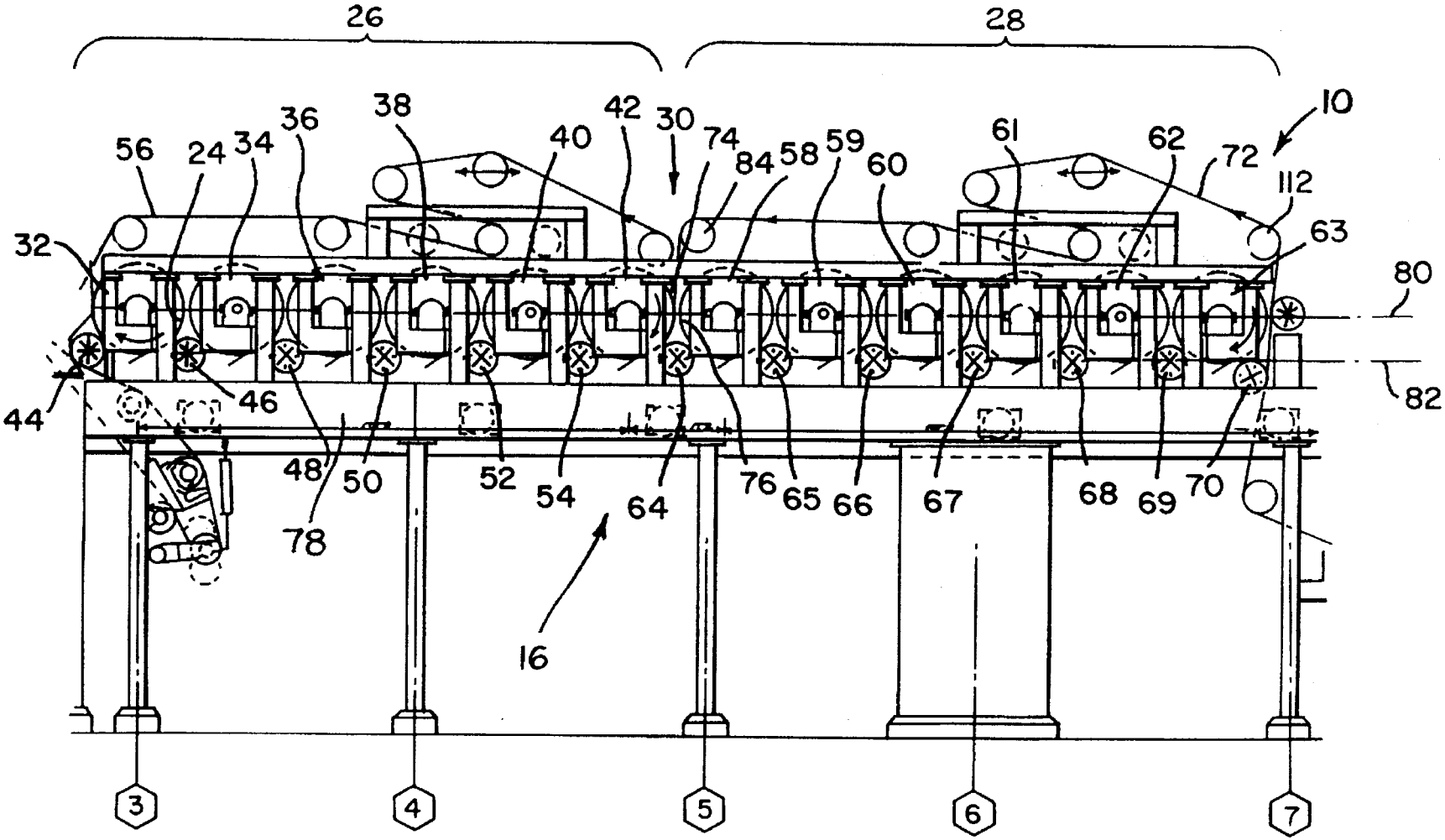
FIG. 3 is an enlarged fragmentary view of FIG. 1 showing the first dryer section means, including the first dryer section and the second dryer section.

FIG. 3 shows in detail the first dryer section means 16. This first dryer section means 16 includes a first dryer section generally designated 26 for initiating the drying of the first side 18 of the web 12. A second dryer section generally designated 28 is disposed downstream relative to the first dryer section 26 for continuing the drying of the first side 18 of the web 12. A second dryer transfer means generally designated 30 transfers the web 12 without open draw between the first and the second dryer sections 26 and 28 respectively.

More particularly, with reference to FIG. 3, the first dryer section also includes a first plurality of dryers 32, 34, 36, 38, 40 and 42 respectively. The first dryer section 26 also includes a first plurality of vacuum rolls 44, 46, 48, 50, 52 and 54 respectively. The first plurality of vacuum rolls 44–54 are disposed adjacent to a corresponding dryer of the first plurality of dryers 32–42 such that the web 12 extends alternately past each vacuum roll 44–54 and dryer 32–42 in serpentine configuration.

A first felt 56 extends around the first plurality of dryers 32–42 and the first plurality of vacuum rolls 44–54 in close conformity with the web 12.

The second dryer section 28 also includes a second plurality of vacuum rolls 64, 65, 66, 67, 68, 69 and 70. The vacuum rolls 64–70 are disposed adjacent to a corresponding dryer of the second plurality of dryers 58–63 such that the web 12 extends alternately past each vacuum roll 64–70 and dryer 58–63 in serpentine configuration.

A second felt 72 extends around the second plurality of dryers 58–63 and the vacuum rolls 64–70 respectively such that the second felt 72 is disposed in close conformity with the web 12.

The second felt 72 and an unfelted portion 74 of the downstream dryer 42 of said first dryers 32–42 defines a first pick-up section generally designated 76 for transferring the web 12 from the unfelted portion 74 onto the second felt 72 so that the web 12 is transferred without draw from the first dryer section 26 to the second dryer section 28.

Each of the vacuum rolls of the first and the second dryer sections 26–28 are disposed in spaced close proximity to their adjacent corresponding dryers such that the felt draw between each of the vacuum rolls and their corresponding dryers is minimal, thereby inhibiting any tendency of the web to flutter relative to the supporting felts 56 and 72 respectively.

As shown in FIG. 3, the apparatus 10 also includes a base frame 78 for rotatably supporting both the first and the second plurality of dryers such that the axis of the first and second plurality of dryers are disposed in a first plane 80 as shown in FIG. 3.

Additionally, the frame 78 rotatably supports the first and second plurality of vacuum rolls such that the axis of the first and the second plurality of vacuum rolls are disposed in a second plane 82 shown in FIG. 3. The first plane 80 is disposed above the second plane 82 as shown in FIG. 3.

As shown in FIG. 3, the apparatus 10 includes an upstream vacuum roll 64 of the second plurality of vacuum rolls and this vacuum roll 64 is disposed in spaced close proximity to the unfelted portion 74 of the downstream dryer 42 of the first dryer section 26.

A first felt roll 84 is rotatably supported by the base frame 78 for guiding the second felt 72 past and in conformity with the unfelted portion 74 of the downstream dryer 42 and thereafter around the upstream vacuum roll 64 of the second dryer section 28 such that the web 12 is transferred from the unfelted portion 74 to the second felt 72 without open draw.

As shown in FIG. 2 referred to hereinbefore the apparatus 10 includes a first transfer means 20 for transferring the web 12 from the press section 14 to the first dryer section means 16. This first transfer means 20 further includes a lead in roll 86 which is disposed in spaced close proximity relative to the press section 14. The first felt 56 extends around this lead in roll 86 for transferring the web 12 from the press section 14 to the first dryer section means 16.

A guide roll 88 is disposed between the lead in roll 86 and the first dryer section means 16 for assisting the transfer of the web 12 from the press section 14 toward the first dryer section means 16.

A transfer felt 90 extends around the guide roll 88 such that the transfer felt 90 and the first felt 56 define therebetween a transfer section 92 for transferring the web 12 from the press section 14 toward the first dryer section means 16.

With further reference to FIG. 2, the first transfer means 20 further includes an upstream vacuum roll 44 of said first dryer section means 16. The upstream vacuum roll 44 cooperates with the first felt 56 and the transfer felt 90 such that the transfer section 92 extends from the guide roll 88 to the upstream vacuum roll 44 so that the web 12 emerging from the transfer section 92 is guided around the upstream vacuum roll 44 into the first dryer section means 16.

Figure 4:
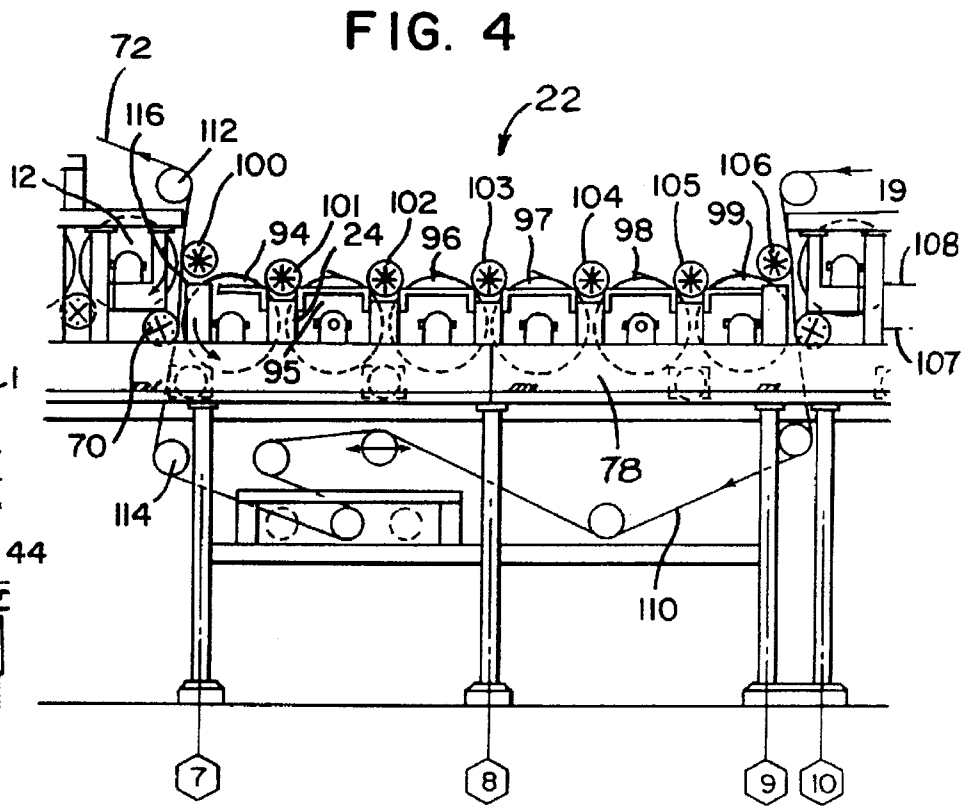
FIG. 4 is an enlarged fragmentary view of FIG. 1 showing the second dryer section means.

With reference to FIG. 4, the second dryer section means 22 also includes a third plurality of dryers 94, 95, 96, 97, 98 and 99. The third plurality of dryers being disposed downstream relative to the first dryer section means 16.

A third plurality of vacuum rolls 100, 101, 102, 103, 104, 105 and 106 are disposed in spaced close proximity relative to a corresponding dryer of the third plurality of dryers such that the web 12 extends alternately past each vacuum roll and dryer of the second dryer section means 22 in serpentine configuration.

As shown in FIG. 4, the base frame 78 rotatably supports each of the dryers of the third plurality of dryers such that the axis of the dryers are disposed in the third plane 107.

The base frame 78 also rotatably supports each of the vacuum rolls such that the axis of each of the vacuum rolls of the third plurality of vacuum rolls are disposed in a fourth plane 108 with the fourth plane being disposed above the third plane.

A third felt 110 extends past the third plurality of dryers and vacuum rolls such that the third felt supports the web through the second dryer section means 22 with the second side of the web being urged by the third felt 110 into close conformity with each dryer of the third plurality of dryers.

As shown in FIG. 4, the first dryer transfer means includes a downstream vacuum roll 70 of the first dryer section means 16 and a downstream felt roll 112 of the first dryer section 16.

The second felt 72 of the first dryer section means 16 extends between the downstream vacuum roll 70 and the downstream felt roll 112. The second felt 72 supports the web 12 that the web is conveyed and disposed between the second felt 72 and the second dryer section means 22.

The first dryer transfer means also includes an upstream vacuum roll 100 and an upstream felt roll 114. A third felt 110 extends between he upstream felt roll 114 and the upstream vacuum roll 100 of the second dryer section means 22 such that the third felt 110 and the second felt 72 define therebetween a first dryer transfer means section 116 for transferring the web without open draw from the second to the third felts 72 and 110 respectively.

The third felt 110 presses against the web such that the second side of the web is pressed into close conformity with each dryer of the third plurality of dryers such that the second side of the web is dried.

Figure 6:
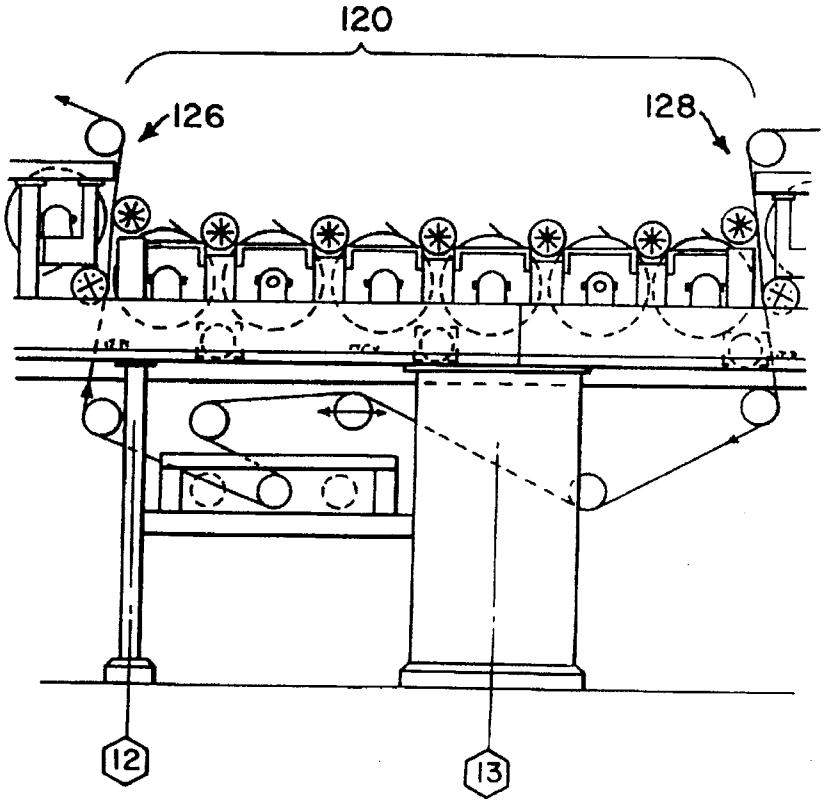
FIG. 6 is an enlarged fragmentary view of FIG. 1 showing the fourth dryer section means.
Figure 5:
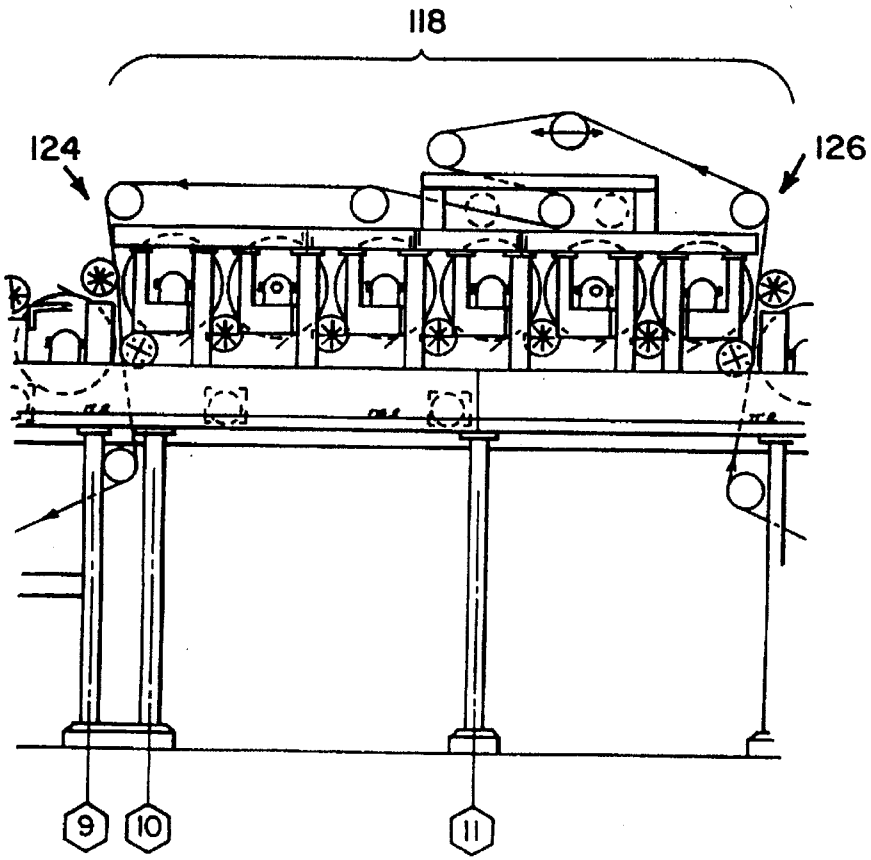
FIG. 5 is an enlarged fragmentary view of the third dryer section means.
Figure 7:
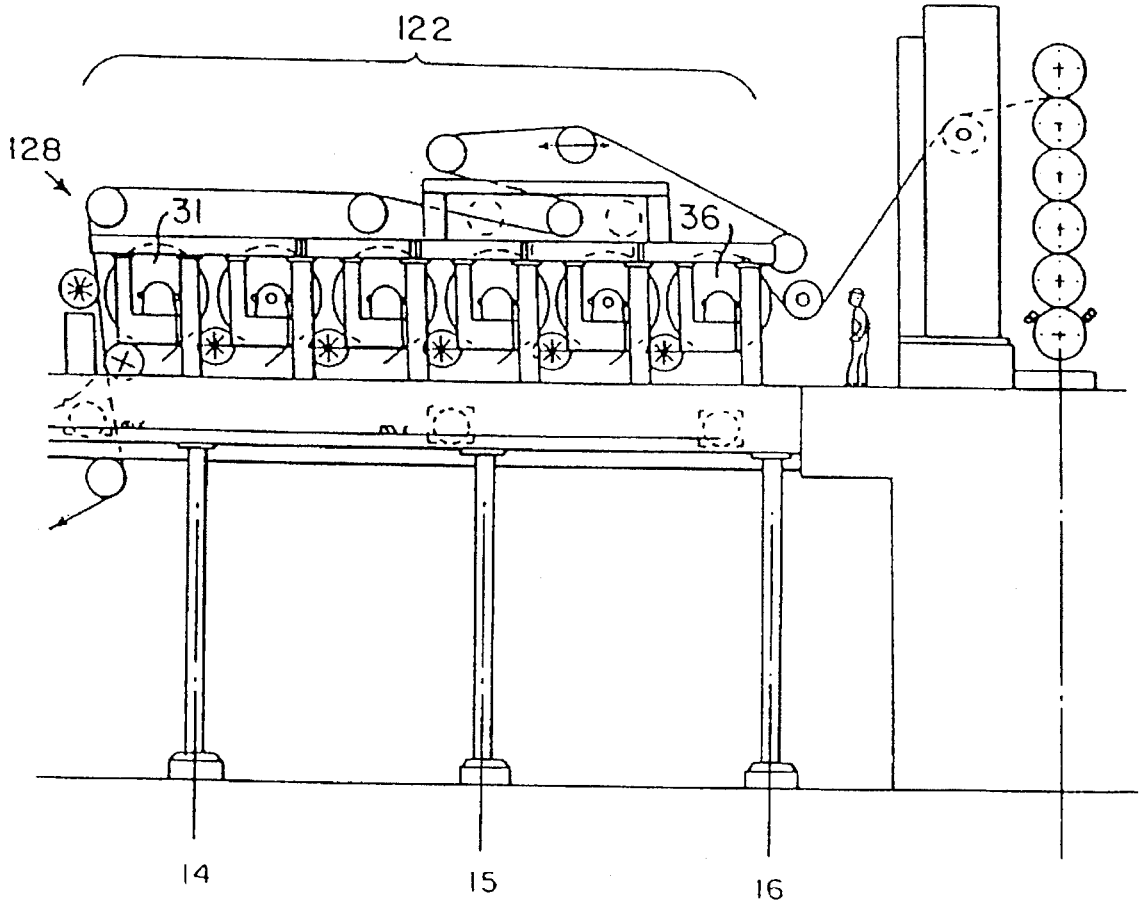
FIG. 7 is an enlarged fragmentary view of FIG. 1 showing the fifth dryer section means.

FIGS. 5, 6 and 7 respectively show third, fourth, and fifth dryer section means respectively and second, third and fourth dryer transfer means 118, 120 and 122 respectively for transferring and reversing the web as the web progresses through the drying apparatus. The first, second, third and fourth dryer transfer means 26, 124, 126 and 128 permit the transfer of the web between the respective dryer sections 16, 22, 118, 120 and 122 without open draw and with an alternate reversing of the web such that the first and second sides of the web are alternately dried as the web extends through the apparatus and past succeeding dryers section means.

Figure 8:
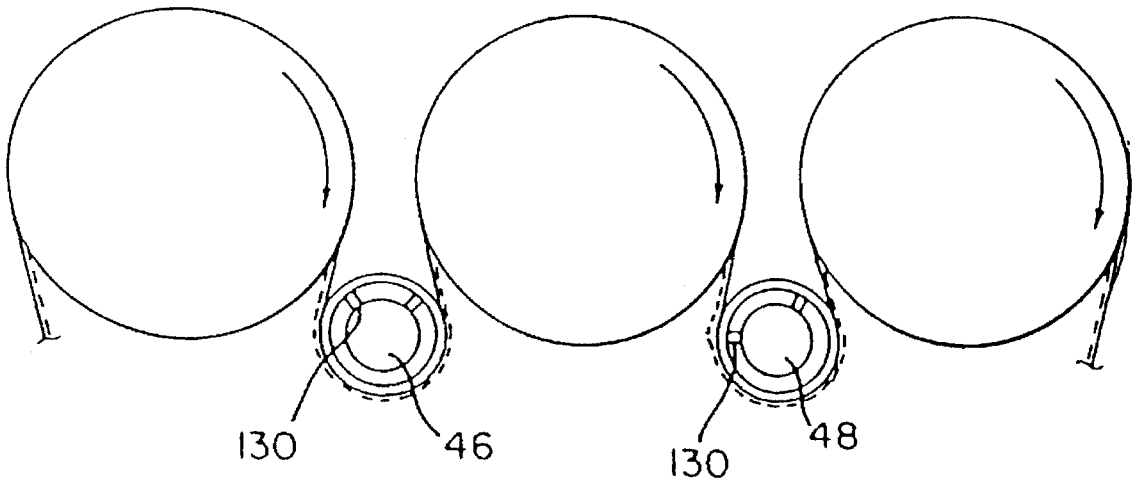
FIG. 8 is a side elevational view of the present invention showing two of the vacuum rolls.

FIG. 8 shows the details of two of the vacuum rolls 46, 48 in which pressure seals 130 may be moved from the position shown with reference to the roll 46 to that shown relative to roll 48 for counteracting the tendency of the web to part from the felt.

In one embodiment of the present invention as shown in FIGS. 1–9, a single tier drying section 16 for drying a web comprises in combination, a dryer 63 and a felt 72 guided about the dryer 63 such that the web is disposed between the dryer 63 and the felt 72 for drying a first side of the web. A further dryer 94 is disposed downstream relative to the dryer 63 and a further felt 110 is guided about the further dryer 94 such that the web is disposed between the further dryer 94 and the further felt 110 for drying a second side of the web. A dryer transfer means 116 transfers the web without open draw from the dryer 63 to the further dryer 94.

More particularly, the dryer transfer means 116 transfers the web without open draw from the dryer 63 to the further dryer 94.

Additionally, the dryer transfer means 116 includes a joint run of the felt 72 and the further felt 110 such that the web is disposed between the felt 72 and the further felt 110 during passage through the joint run.

Also, the dryer transfer means 116 further includes vacuum means 100 disposed downstream relative to the joint run for positively maintaining the web in close conformity with the further felt 110 when the felt 72 and further felt 110 diverge relative to each other downstream relative the joint run.

In a specific embodiment of the present invention, the vacuum means 100 is a vacuum roll.

Preferably, the single tier drying section 16 extends from a press section 14 to a calender section 130 or to a size press (not shown) or throughout the entire dryer section calender section 130. The single tier drying section 16 includes a multiplicity of single tier subsections 16,22,118,120 and 122 and the dryer transfer means 116 includes a plurality of transfer mechanisms 26,124,126 and 128 each transfer mechanism 26,124,126, and 128 being disposed between adjacent subsections such that as the web progresses through subsequent subsections 16,124,126, and 128 alternate sides of the web are dried.

The arrangement is such that alternates sides 18 and 24 of the web are sequentially dried as the web progresses through the subsections 16,22,118,120 and 122.

Additionally, the subsections 16,22,118,120 and 122 are disposed at different heights relative to each other and preferably every other subsection 16,118 and 122 and 22 and 120 are disposed at the same height relative to each other.

Figure 9:
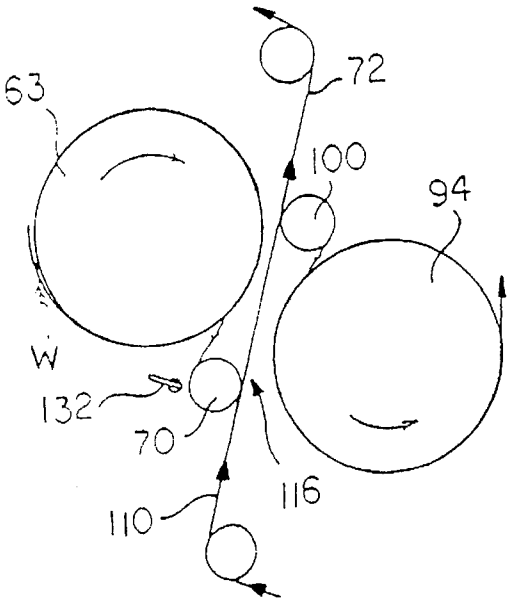
FIG. 9 is a side elevational view of one embodiment of the present invention showing the air nozzle means for assisting guidance of the tail of the web from the dryer to the further dryer.

As shown particularly in FIG. 9, the dryer transfer means 116 also includes air nozzle means 132 for assisting guidance of the web from the dryer 63 to the further dryer 94.

Figure 10:
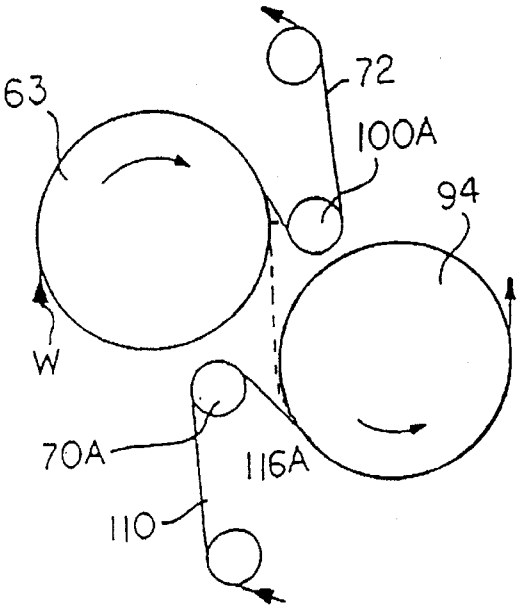
FIG. 10 is a side elevational view of a further embodiment of the present invention showing an open draw transfer.

In an alternative embodiment shown in FIG. 10, the transfer means 166A also includes means 100A and 70A for transferring the web with open draw form the dryer 63A to a further dryer 94A.

Figure 11:
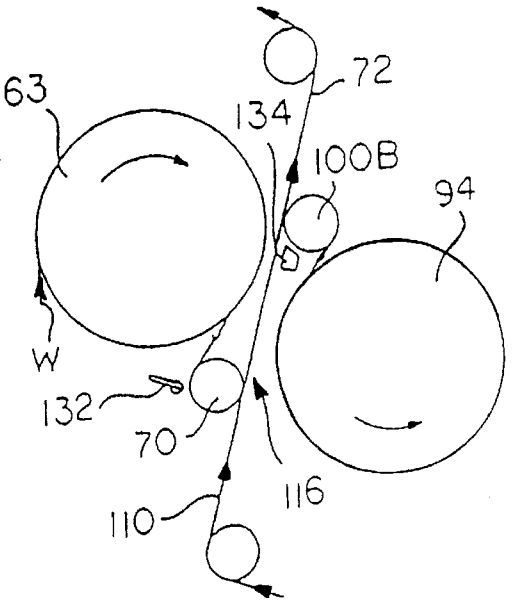
FIG. 11 is a side elevational view of a further embodiment of the present invention showing a transfer box.

In a further embodiment of the present invention as shown in FIG. 11, the transfer mechanism includes a transfer box 134 adjacent to a turning roll 100B which may be grooved. The transfer box 134 may be a vacuum box or a blow box having a coanda effect nozzle for transferring the web so that it follows roll 100B.

In operation of the apparatus, the web is transferred from the press section to a first dryer section of the apparatus drying of the first side of the web is initiated during passage of the web through the first dryer section 16. The web is transferred without open draw between the first dryer section 16 and a downstream second dryer section 22 with the web transfer being such that the web is reversed so that drying of the second side of the web initiate during passage of the web through the second dryer section 22.

In operation of the apparatus the web is also transferred without open draw between subsequent dryer sections such that the first and second sides of the web are alternately exposed to the drying effect of the subsequent dryer section in sequence.

The present invention provides a drying section which is capable of operating at extremely high speeds as no open draws exist between the various sections thereof. Furthermore, the present invention enables threading of the drying section without the use of threading ropes.

Figure 12:
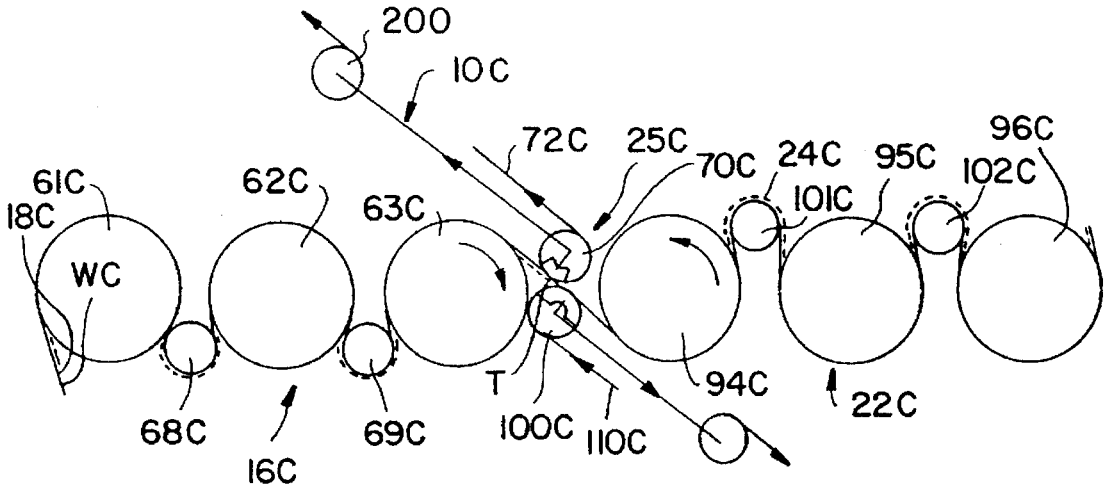
FIG. 12 is a side elevational view of a further embodiment of the present invention for controllably transferring a tail from a single tier group to a further single tier group.

FIG. 12 is a side elevational view of a flutter embodiment of the present invention. FIG. 12 shows a single tier drying section generally designated 10*c* for drying a web wc. The drying section 10*c* includes a single tier group of dryers 16*c* for drying a first side 18*c* of the web wc.

A felt 72*c* extends around each of the dryers 61*c*, 62*c*, 63*c* of the group 16*c* such that the web wc is disposed between the felt 72*c* and each of the dryers 61*c*–63*c*.

A further single tier group of dryers 22*c* is disposed downstream relative to the single tier group 16*c* for drying a second side 24*c* of the web wc. Transfer means generally designated 25*c* are disposed between the group 16*c* and the further group 22*c* for controllably transferring a tail T of the web wc and for subsequently controllably transferring a threaded web wc from the group 16*c* to the further group 16*c* such that the tail T is transferred without the assistance of threading ropes.

The transfer means 25*c* includes a vacuum roll 70*c* disposed immediately downstream relative to the group of dryers 16*c* such that the felt 72*c* extends from the group 16*c* to and around the vacuum roll 70c for guiding the tail T and subsequently the threaded web wc from the group of dryers 16c to the vacuum roll 70c.

A further vacuum roll 100c is disposed downstream relative to the vacuum roll 70c. The further vacuum roll 100c is disposed between the vacuum roll 70c and the further group of dryers 22c. The further vacuum roll 100c is disposed in close proximity to the vacuum roll 70c such that when the further vacuum roll 100c is connected to a source of partial vacuum, the tail is urged and drawn from the vacuum roll 70c toward the further vacuum roll 100c.

A further felt 110c extends from the further vacuum roll 100c to the further group of dryers 22c for guiding the tail T controllably drawn from the vacuum roll 70c such that the tail T and subsequently the threaded web wc is guided from the further vacuum roll 100c to the further group of dryers 22c. The arrangement is such that the tail T is automatically guided and threaded from the group 16c to the further group 22c without the assistance of threading ropes.

Figure 13:
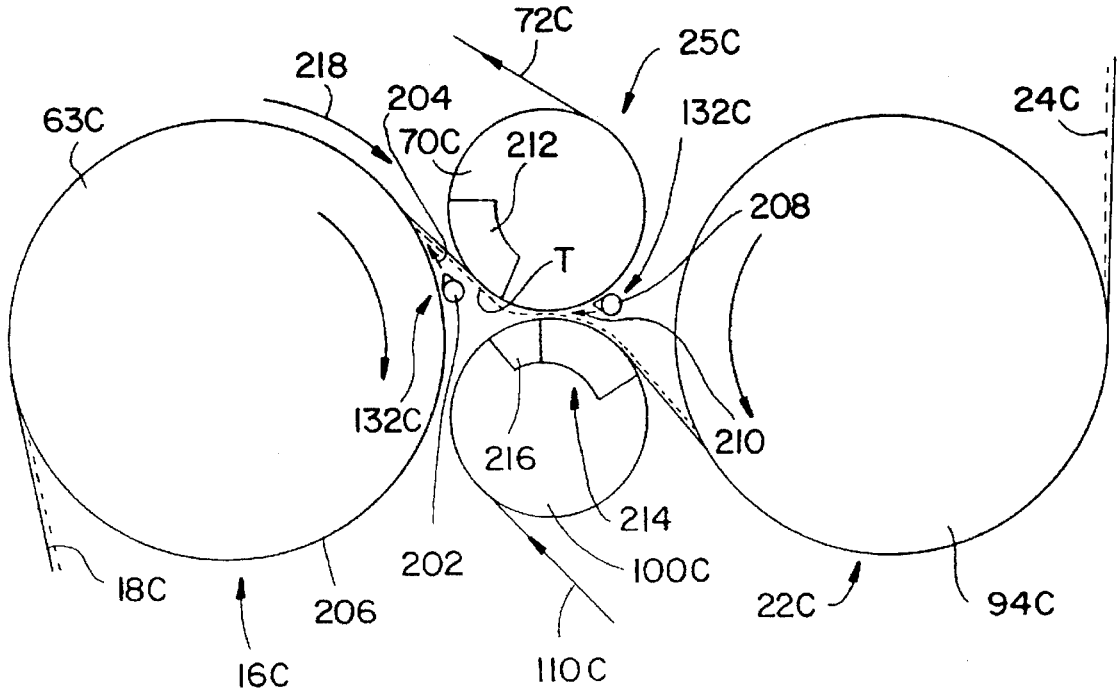
FIG. 13 is an enlarged view of the transfer means shown in FIG. 12.

Additionally, as shown in FIGS. 12 and 13, the transfer means further includes air nozzle means 132c disposed in the vicinity of the vacuum rolls 70c and 100c for assisting transfer of the tail T from the group 16c to the further group 22c.

The air nozzle means also includes a first air nozzle 202 disposed between the group 16c and the vacuum roll 70c for directing a first flow of air 204 toward the tail T in a direction generally opposite to a direction of travel of the tail T for urging the tail T to follow the felt 72c rather than a heated surface 206 of a last dryer 63c of said group 16c.

A second air nozzle 208 is disposed between the vacuum rolls 70c and between the further group 22c for directing a further flow of air 210 toward the vacuum roll 70c and in a further direction generally opposite to the direction of travel of the tail T for assisting detachment of the tail T from the vacuum roll 70c so that the tail T is drawn toward the further felt 110c extending around the further vacuum roll 100c.

In operation of the alternative embodiment of the present invention according to FIGS. 12 and 13, the web wc is guided around the single tier dryer group 16c which includes at least dryer 61c–63c and vacuum roll 68c–69c.

The felt 72c urges the web wc into close conformity with each of the dryers 61c–63c such that the first side 18c of the web wc comes into contact with the heated surface 206 of each of the dryers.

The vacuum rolls 68c–69c are disposed in close proximity to the respective adjacent dryers 61c–62c, 62c–63c such that the felt draw for example between dryer 61c and vacuum roll 68c is minimal thereby inhibiting fluttering of the web relative to the supporting felt 72c.

The term close proximity as used with reference to the disposition of the dryer 61c to vacuum roll 68c will vary according to the grade of paper or board being manufactured but would generally mean that the shortest distance between the surfaces of, for example, dryer 61c and 68c would be less that 5 inches. Those skilled in the art will appreciate that the vacuum roll 68c, for example, would be located as close as possible to the adjacent dryer 61c–62c commensurate with the objective of minimizing web flutter while avoiding any problems resulting from a web breakage and a resultant winding of the web around, for example, the dryer 61c.

In the event of the aforementioned winding around dryer 61c, the aforementioned shortest distance should be such as to permit a shut down without causing damage to either the dryer 61c or the vacuum roll 68c.

Additionally, in certain countries minimum distances have been legislated in order to protect an operator so that the operators hand can extend through the clearance between the dryer and adjacent vacuum roll.

During a start-up operation, a narrow tail is cut upstream relative to the dryer section. The trail is usually 6 inches wide and is cut in a machine direction along one edge of the web.

Due to the relatively high vacuum within the vacuum roll 68c–69c and particularly in the event of such vacuum rolls 68c–69c having evacuated end boxes therein, the tail is automatically threaded through the first group 16c.

Thereafter, as particularly shown in FIG. 13, the first air nozzle 202 directs a flow of air 204 in a direction opposite to the direction of movement of the tail T so that the tail is urged away from the hot surface 206 of the dryer 63c such that the tail follows the dryer felt 72c.

A high vacuum within the vacuum pick-up roll pocket 212 draws the tail T toward the felt 72c as the felt 72c extends around the vacuum roll 70c.

A second air nozzle 208 shown in FIG. 13 blows a current of air 210 in a direction opposite of the direction of movement of the tail supported by the felt 72c extending around the vauum roll 70c.

Additionally, the further vacuum roll 100c includes an evacuated pocket generally designated 214 having a very high level vacuum zone 216 which positively transfers the leading edge of the tail onto the further felt 110c so that the tail T is guided by the further felt 110c to and around the dryer 94c for drying the second side 24c of the web.

The provision of the evacuated pocket 212 also assists in removal of boundary air 218 that follows the dryer 63c.

Furthermore, by the aforementioned arrangement, the felt draw between the dryer 63c and vacuum roll 70c is minimized thereby reducing web flutter and assisting restraint of the subsequently threaded web against machine and cross machine directional shrinkage.

Similarly, the felt draw between dryer 94c and the further vacuum roll 100c is reduced to a minimum so that web flutter is reduced to a minimum and so that cross machine and machine directional shrinkage of the web during transfer is minimized.

Figure 14:
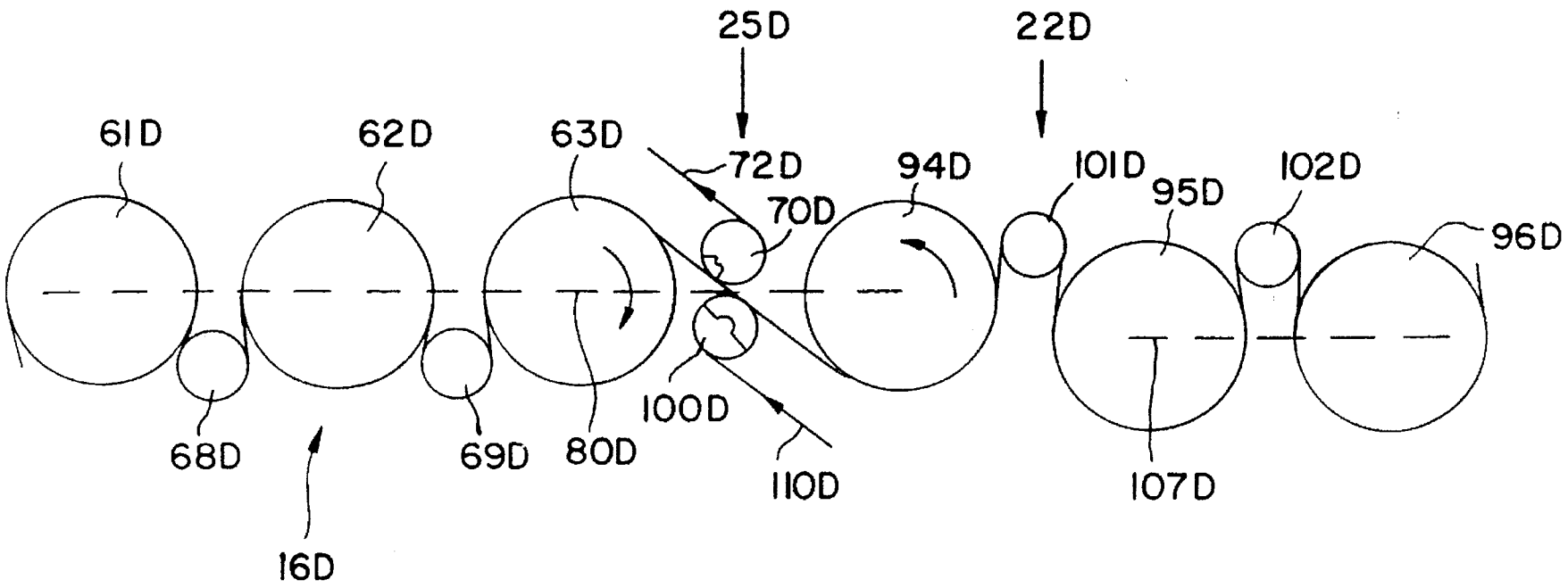
FIG. 14 is a side elevational view of a variation of the embodiment shown in FIG. 12 showing at least one of the dryers of the further group having an axis of rotation disposed in a plane which is different to the plane of the dryers in the single tier group.

The embodiment shown in FIG. 14 is basically the same as that shown in FIGS. 12 and 13. However, in order to facilitate access to the bottom felted dryers 95d and 96d, the plane 107d extending through the axes of rotation of the dryers 95d, 96d is different and lower than the plane 80d of the dryers 61d–63d.

Those skilled in the art will also appreciate that it may be possible to use a plain felt roll as a substitute for the vacuum roll 70c if the air nozzle 202 provides sufficient air flow to peal the tail and the subsequent full width web from the hot surface 206.

What is claimed is:

1. A drying section apparatus for drying a web of paper, said apparatus comprising:

a single tier group of dryers for drying a first side of the web;

said group including:

at least two dryers:

a roll;

a felt extending around said roll and guided thereby, the arrangement being such that said felt is disposed between the web and said roll;

a further single tier group of dryers disposed downstream relative to said group for drying a second side of the web;

said further single group including:

at least two further dryers;

a further roll;

a further felt extending around said further roll and guided thereby, the arrangement being such that said further felt is disposed between the web and said further roll;

said group and said further group being positioned and arranged relative to each other to define therebetween a transfer section, the arrangement being such that the web extending between said group and further group is supported by, and in physical contact with, less than both of said felts; and said roll and said further roll being vacuum rolls, the arrangement being such that the web is disposed in close conformity with said felt during movement of the web around said roll, the web being disposed in close conformity with said further felt during movement of the web around said further roll.

* * * * *